US011022392B2

(12) United States Patent
Wallgren

(10) Patent No.: US 11,022,392 B2
(45) Date of Patent: Jun. 1, 2021

(54) CHILD FIREARM SAFETY LOCK ALLOWING ADULT PROFICIENCY TRAINING

(71) Applicant: GW Solutions of Duluth, LLC, Duluth, MN (US)

(72) Inventor: Gregory Wilhelm Wallgren, Duluth, MN (US)

(73) Assignee: Gregory Wilhelm Wallgren, Duluth, MN (US)

( * ) Notice: Subject to any disclaimer, the term of this patent is extended or adjusted under 35 U.S.C. 154(b) by 0 days.

(21) Appl. No.: 16/434,389

(22) Filed: Jun. 7, 2019

(65) Prior Publication Data

US 2020/0386500 A1 Dec. 10, 2020

(51) Int. Cl.
*F41A 17/44* (2006.01)

(52) U.S. Cl.
CPC ..... *F41A 17/44* (2013.01)

(58) Field of Classification Search
CPC ..... F41A 17/44
See application file for complete search history.

(56) References Cited

U.S. PATENT DOCUMENTS

| | | | | |
|---|---|---|---|---|
| 5,289,653 | A | 3/1994 | Szebeni et al. | |
| 5,638,627 | A | 6/1997 | Klein et al. | |
| 5,950,344 | A | 9/1999 | Ross | |
| 6,212,813 | B1 | 4/2001 | Luna et al. | |
| 6,393,750 | B1 * | 5/2002 | Rossini | F41A 17/02 42/70.11 |
| 6,604,313 | B1 * | 8/2003 | Kress | F41A 17/44 42/70.11 |
| 9,939,220 | B2 | 4/2018 | Speller | |
| 1,000,622 | A1 | 6/2018 | Szebeni | |
| 2002/0121039 | A1 * | 9/2002 | Kellerman | F41A 17/44 42/70.11 |
| 2004/0060219 | A1 * | 4/2004 | Weinraub | F41A 17/44 42/70.11 |
| 2016/0076843 | A1 * | 3/2016 | Masters | F41A 17/44 42/1.01 |
| 2017/0167815 | A1 * | 6/2017 | Speller | F41A 17/44 |
| 2017/0191774 | A1 * | 7/2017 | Pittman | F41A 17/44 |

* cited by examiner

*Primary Examiner* — J. Woodrow Eldred

(57) ABSTRACT

A safety lock for a firearm comprises a casing, a releasable locking member at a second end, and a flexible member between the first end and the second end. When the lock is installed on the firearm, the lock extends along the barrel from the chamber to the muzzle end. When in the locked position, the casing is positioned in the chamber and the flexible member extends along the barrel, an ammunition round from being loaded. The safety lock allows a user to dry fire the firearm.

13 Claims, 6 Drawing Sheets

CHILD FIREARM SAFETY LOCK ALLOWING ADULT PROFICIENCY TRAINING

FIELD OF THE INVENTION

The present invention relates to firearms and firearm safety. Particularly, the present invention relates to devices and methods for locking a firearm to minimize the risk from unauthorized use or the possibility of discharge, while also reducing firearm damage during training exercises.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Gun owners often purchase firearms for the purpose of self-defense and protection. Proper use of a firearm requires comfort, confidence, and skill. To build comfort, confidence, and skill with one's firearm, training and practice is often required. A user needs to practice inserting and removing the magazine, operating the slide, and otherwise operating the gun in a safe setting. Self-defense and protection training may also require practicing different scenarios where a user may need to use its firearm.

Firearm safety is an important part of gun ownership. There are two primary types of safety locks for firearms: trigger locks and cable locks. Trigger locks can be installed within the trigger guard of the firearm and prevent the trigger from being pulled by blocking access to the trigger when locked. Because the trigger lock blocks access to the trigger, someone training on the firearm is unable to get the feel of the trigger during various training exercises. Cable locks comprise a cable and a padlock, similar to a lock for a bicycle. One end of the cable is permanently fixed to the padlock, and the other end of the cable may engage with the padlock when the cable lock is in the locked position. With the slide of the firearm open, the cable is inserted into the magazine compartment, out through the ejection port, and looped back down along the grip until it the other end is engaged with the padlock. Because the cable lock blocks the magazine compartment, someone training on the firearm cannot train on inserting and removing a magazine clip into the gun. Because the cable lock is inserted with the slide of the firearm open, the cable lock prevents someone from practicing opening and closing the slide during training exercises. Firearm storage in this condition keeps the hammer or striker mechanism and slide springs in tension, causing unnecessary wear. Additionally, portions of the cable of the cable lock may extend outwardly from the chamber in a way that blocks the firearm's sights. Trigger locks and cable locks, while disabling the firearm from discharging a round, do not provide a user with full access to important features of the firearm to allow a user to train on these features.

In some instances, a user may want to practice with their firearm in what is commonly referred to as a "dry fire" exercise or "dry firing." When dry firing the firearm, the user can simulate firing the weapon without ammunition. Both the trigger and the hammer or striker fully operate without ammunition. In some circumstances, dry firing a firearm may cause unnecessary wear or internal damage to the barrel, the firing pin, the hammer or the striker of the firearm.

Thus, there is a need in the art for a safety mechanism to prevent live ammunition from being loaded, while simultaneously allowing a person to safely train on aspects and features of the firearm for use in various tactical and self-defense scenarios.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one embodiment, relates to an improved safety lock for a firearm that allows a user to use various features of the gun in training exercises to improve a user's skill and confidence with the firearm. The safety lock may comprise a casing at a first end; a releasable locking member at a second end; and a flexible member between the first end and the second end. The casing may be sized appropriately for the firearm based on the firearm's caliber. In at least one embodiment, the casing may be hollow to allow for attachment of the flexible member to the casing. In some embodiments, the casing may comprise a retrieval feature to assist with removing the safety lock from the firearm. In some embodiments, the flexible member may comprise metal, plastic, or other suitable material. In some embodiments, the flexible member may have a coating to facilitate smooth insertion and retrieval from the barrel of the gun. In some embodiments, a tool will be provided to assist with removal of the safety lock from the firearm. In some embodiments, a protective sheath may be provided to cover at least the end of the locking member during insertion and removal of the safety lock device from the firearm, preventing any metal-on-metal contact with the chamber and rifling within the barrel. In some embodiments, the releasable locking member has a security feature that enables the locking member to be released from the flexible member. In some embodiments, the releasable locking member may comprise a padlock body. The flexible member may comprise a tip at the second end for engagement with the releasable locking member. When installed, the safety lock may allow the firearm to be used in "dry fire" exercises while minimizing damage to the firing pin since the safety lock uses a casing. The safety lock may provide users with substantial functionality of the firearm during training exercises, except the extraction cycle and the loading of live ammunition.

In at least one embodiment, a locked firearm comprising: a chamber, a muzzle end, a barrel extending from the chamber to the muzzle end, and a lock extending along the barrel from the chamber to the muzzle end. The lock may comprise a shell casing at a first end positioned in the chamber; and a flexible member connected to the shell casing, the flexible member extending along the barrel; and a locking member at a second end. The locking member may be removably engaged with the flexible member. In some embodiments the firearm has sights, and the sights are unobstructed by the lock in a locked position. The lock may still permit a user to insert and remove a magazine clip of the locked firearm. The lock may permit the user to safely operate the slide (also known as "racking" the slide) of the locked firearm, which is particularly desirable for certain types of firearms such as striker fired firearms which may need to be cocked. For hammer fired firearms, it may not be necessary to cock such firearms, but use of the slide and slide stop can be an important function when loading a firearm. The lock may permit a user to operate the trigger of the locked firearm. The lock may also permit a user to operate at least one of the factory-installed safety and the slide of the locked firearm.

In at least one embodiment, a method of locking a firearm may comprise retracting a slide of the firearm to expose a chamber of the firearm; inserting an end of a flexible member into the chamber; feeding the flexible member through a barrel of the firearm until a tip of the flexible member is exposed from a muzzle of the firearm and a hollow casing attached to the flexible member is positioned into the chamber; and then engaging a locking member with the tip.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with Figures that are displayed within the text below of this application.

DETAILED DESCRIPTION

Figure 1:
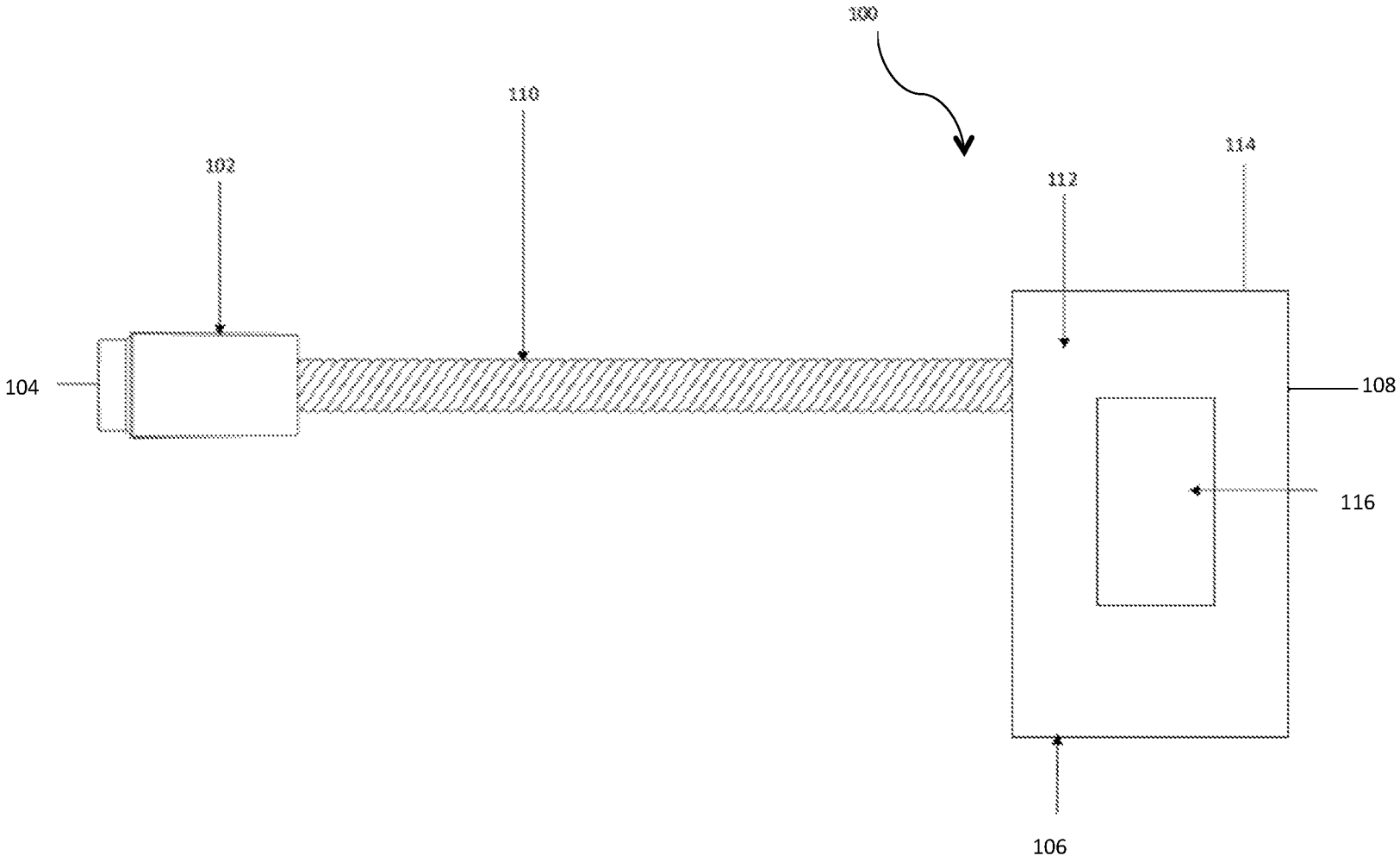
FIG. 1 is a side view of a firearm lock of the present invention, according to one embodiment.

The present disclosure relates to a novel and advantageous firearm lock that allows a person to train on all aspects of the gun, even though the firearm is preventing a user from discharging a round. While the invention is amenable to various modifications and alternative forms, specifics thereof are shown by way of example in the drawings and described in detail herein. It should be understood, however, that the intention is not to limit the invention to the particular embodiments described. On the contrary, the intention is to cover all modifications, equivalents, and alternatives falling within the spirit and scope of the invention.

Figure 2:
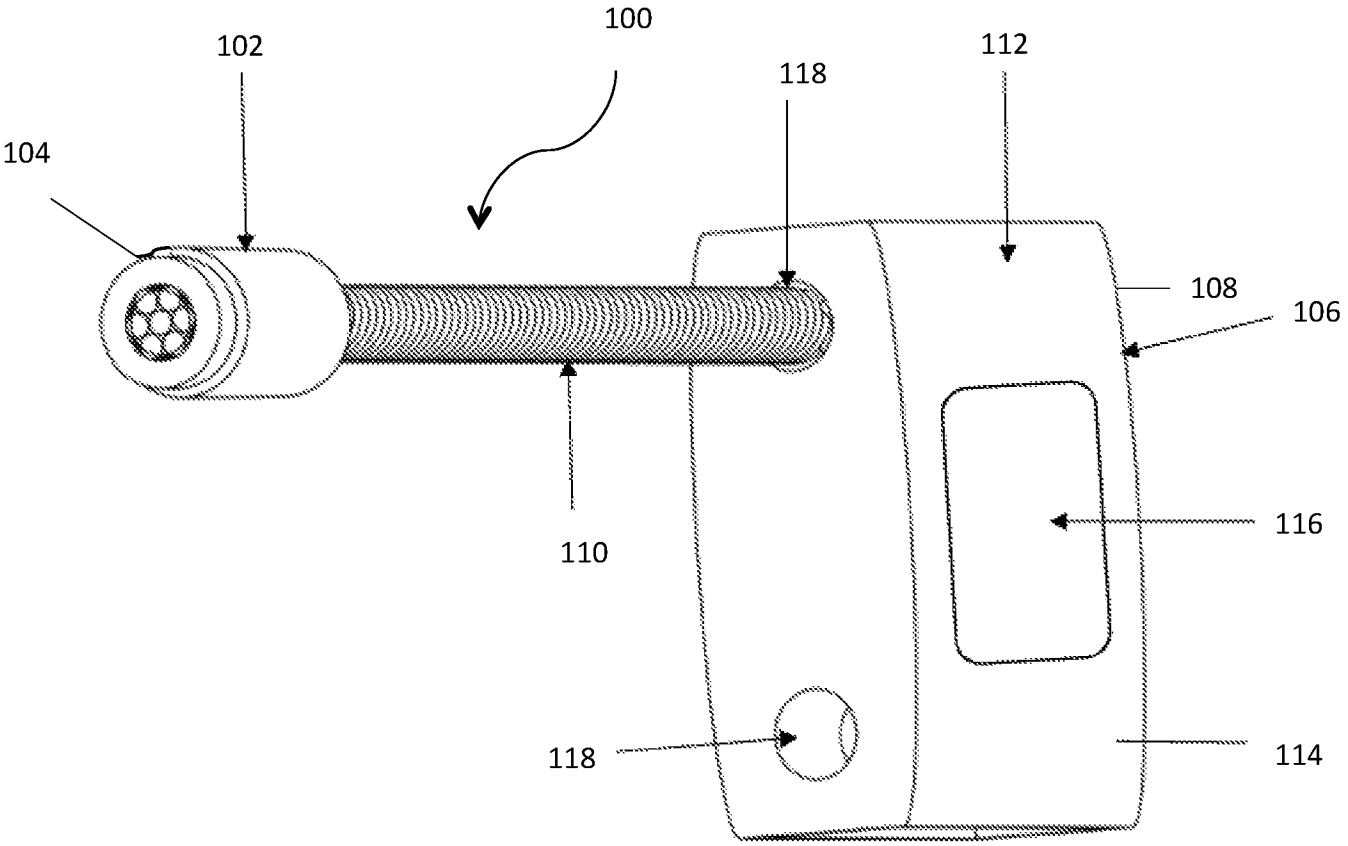
FIG. 2 is a perspective view of the firearm lock of FIG. 1.
Figure 3:
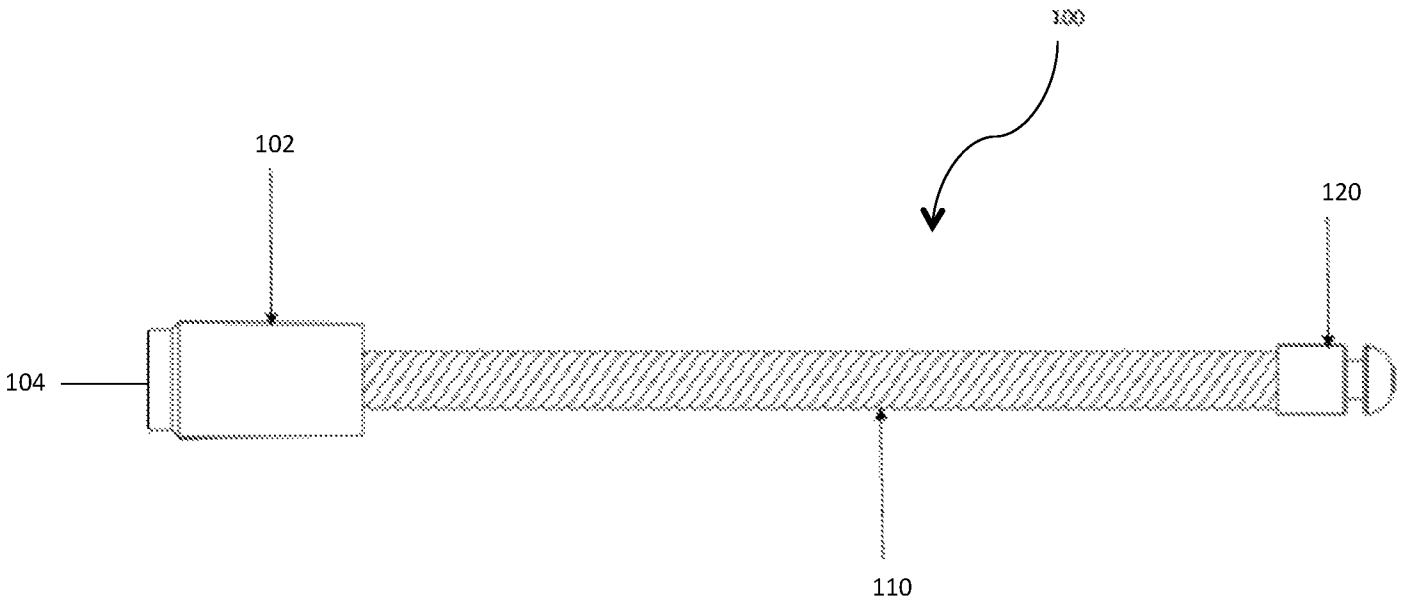
FIG. 3 is a side view of the firearm lock of FIG. 1, with the locking member removed.

FIGS. 1-2 show one embodiment of a firearm lock 100 of the present invention. The firearm lock 100 comprises a casing 102 at a first end 104, a locking member 106 at a second end 108, and a flexible member 110 between the casing 102 and the locking member 106. In some embodiments, the casing 102 may be similar to a casing from ammunition of the type and caliber suitable for the firearm. The casing may be sized in a range of calibers from .22 to .45. For example, the casing may comprise a casing similar to ammunition of one or more of the following calibers: .22 rimfire, .22 magnum, .380, .22, .40, 9 mm, 10 mm, .45, .38, .357, .308, and others. For shotguns, the casing may comprise a casing similar to ammunition of one or more of the following calibers: 410 gauge, 20 gauge, 12 gauge, and others. For rifles, the casing may comprise a casing similar to ammunition in the range of the following calibers: .223 through .50 BMG. In at least one embodiment, the casing may have a diameter between about 0.17 inches and 0.51 inches. In some embodiments, the casing may be hollow. The hollow casing, in all embodiments, does not contain any primer or gunpowder. In some embodiments, the casing may be an actual casing used for ammunition, but without any primer or gunpowder. Actual casings used for ammunition typically have an extraction groove at one end of the casing. In some embodiments, as shown in FIGS. 1-3, the extraction groove has been removed from the casing 102 near the first end 104. In other embodiments, the casing 102 may still have the extraction groove. In some embodiments, the casing 102 may comprise metal. In some embodiments, the casing 102 may comprise plastic that is suitable to prevent damage to the barrel. In some embodiment, the casing 102 may comprise a retrieval feature for easy removal of the firearm lock from the chamber. In some embodiments, the casing 102 is fixedly engaged to one end of the flexible member 110. In one embodiment, the casing 102 may be welded, glued, or otherwise attached to the first end of the flexible member 110. The flexible member 110 may have a diameter less than or equal to the diameter of the casing 102. The flexible member 110 may comprise metal or a polymer. The flexible member 110 may have a polymer coating, a lubrication coating, or a protective sheath to assist with feeding the flexible member 110 into the barrel of the firearm. In at least one embodiment a portion of the flexible member 110 may comprise a cleaning feature to assist with cleaning the barrel of the gun. In at least one embodiment, the cleaning feature may be positioned near the second end of the flexible member. The locking member 106 may comprise a padlock body 112 having a case 114. The locking member 106 may have a security feature 116 to engage the locking member 106 into a locked position relative to the flexible member 110. The security feature 116 may comprise a keyhole for use with a key, a combination dial, a keypad, a fingerprint sensor, a wireless or Bluetooth device, sensor, or any other suitable security mechanism to verify the user and secure the locking member. The locking member 106 may comprise at least one engagement port 118 at a first end of the locking member 106 for engaging the flexible member 110 with the locking member 106. As shown in FIG. 2, the locking member 106 may have two engagement ports 118. In at least one embodiment, a first engagement slot 118 may have a first diameter and a second engagement port 118 may have a second diameter so that the locking member 106 may be used with flexible members of different diameters, and therefore with firearms of different calibers.

FIG. 3 shows the firearm lock 100 of FIG. 1 with the locking member 106 removed. As shown in FIG. 3, the flexible member 110 has a tip 120 that may be removably engaged with the locking member 106. The tip may comprise metal, polymer, rubber, or other suitable material. In at least one embodiment, the tip 120 may comprise a cleaning feature to assist with cleaning the barrel of the gun. The tip 120 releasably engages with an engagement port 118 of the locking member 120.

Figure 4:
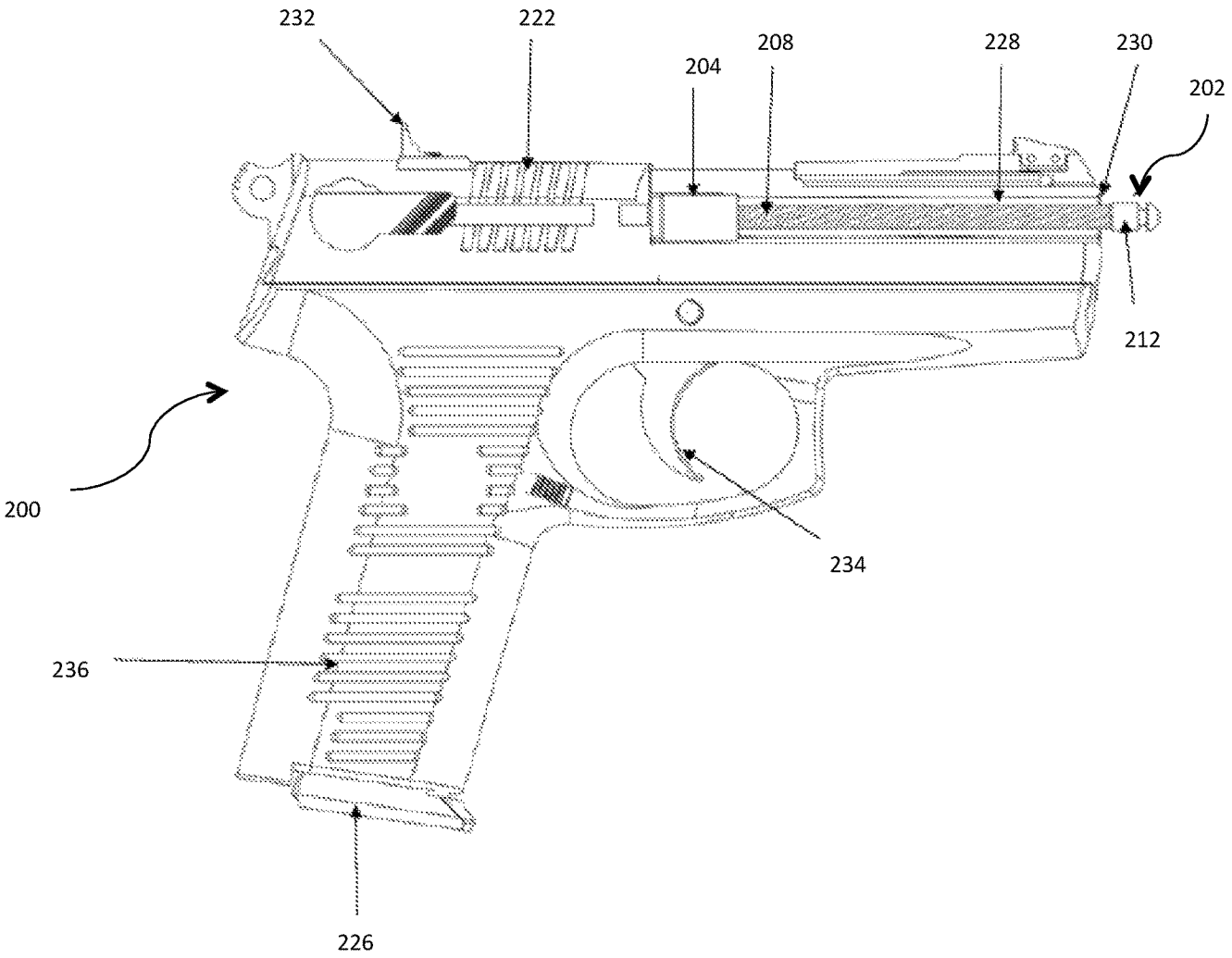
FIG. 4 is a cross-sectional view of a firearm with the firearm lock partially installed.
Figure 5:
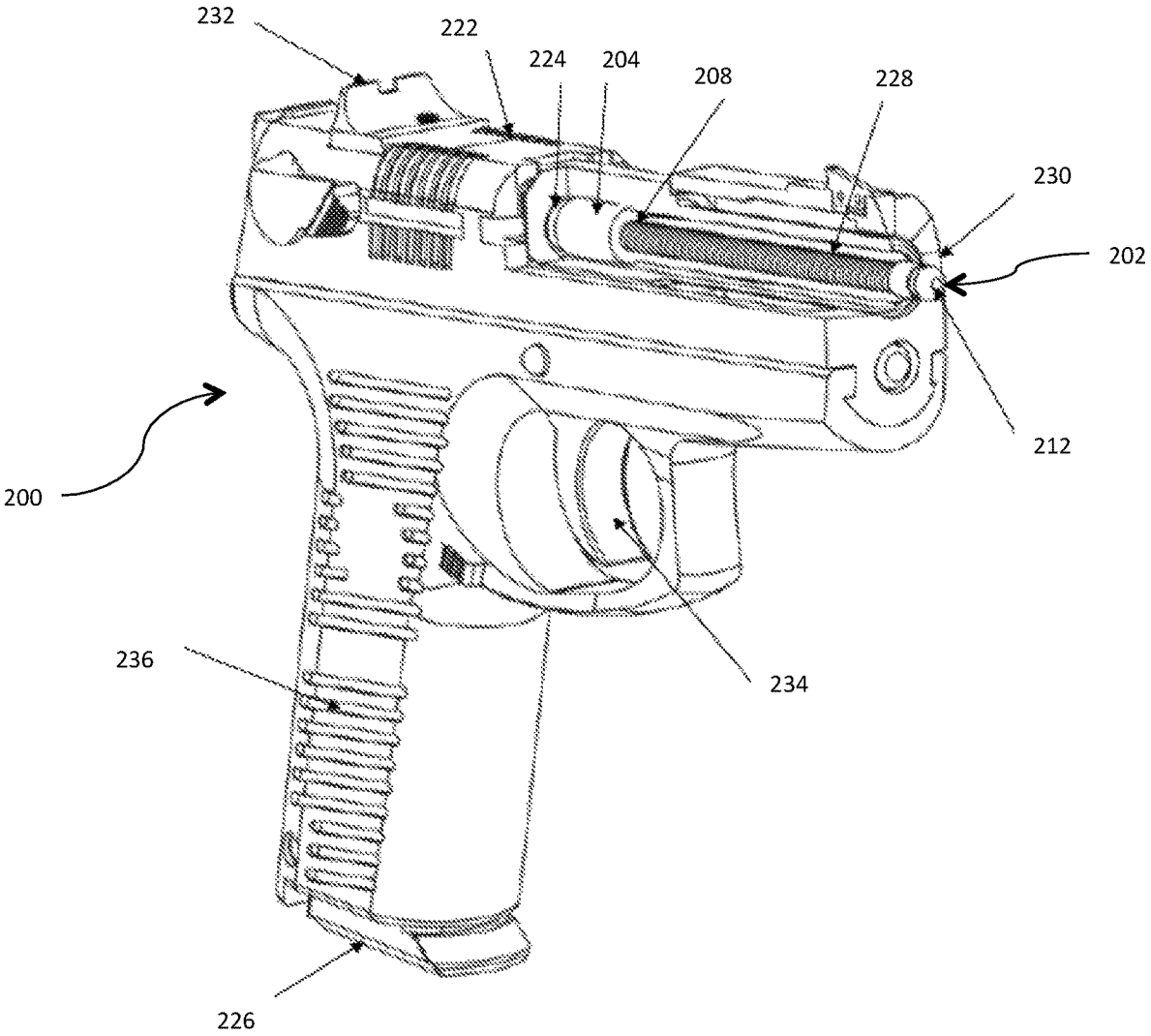
FIG. 5 is a cross-sectional view of the firearm in FIG. 4.
Figure 6:
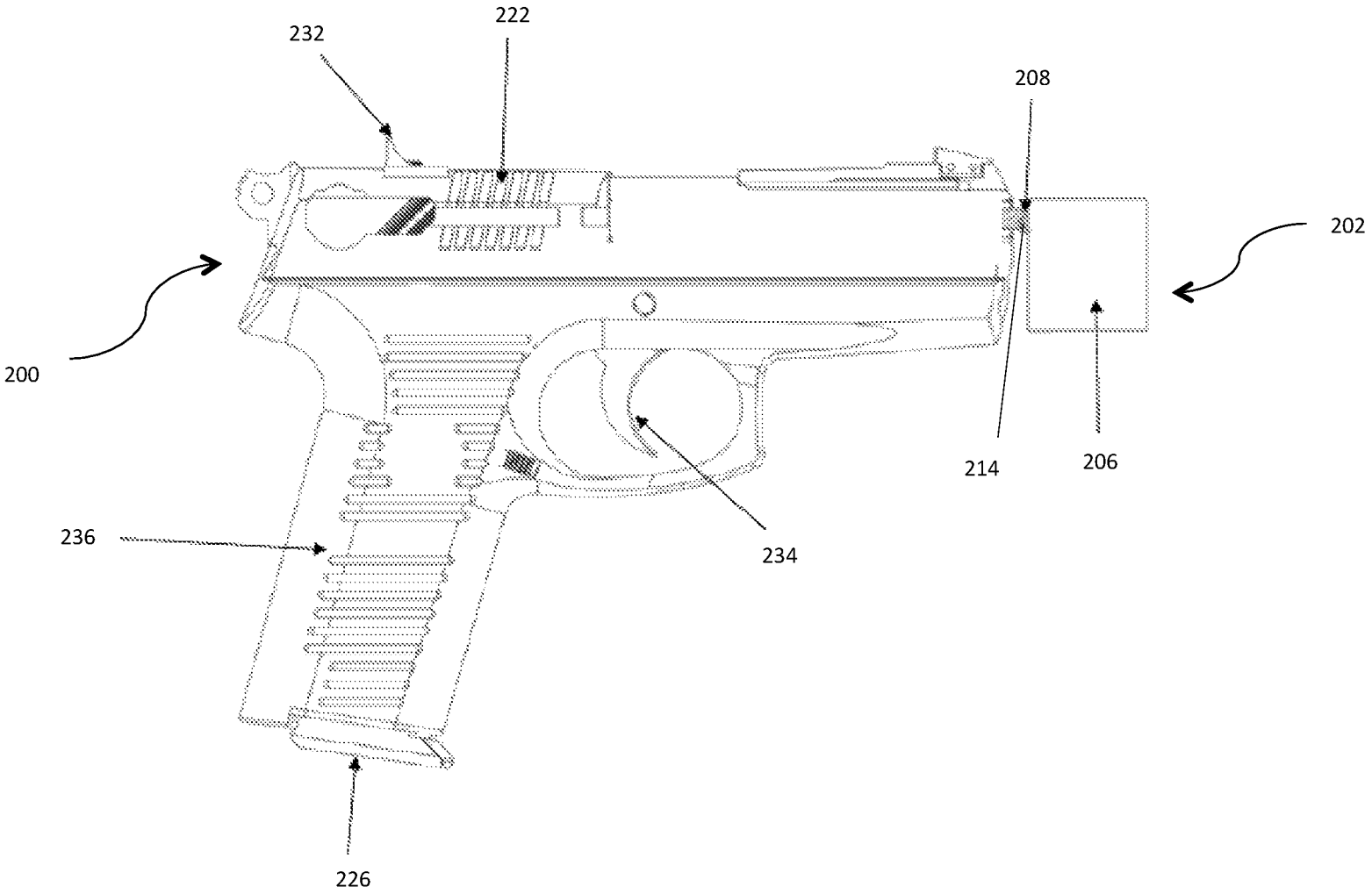
FIG. 6 is side view of the firearm in FIG. 4 with the firearm lock in the safe position.

FIGS. 4-6 show one method of the present embodiment for locking the firearm using one embodiment of the firearm lock of the present disclosure. FIGS. 4-5 show cross-sectional views of a firearm 200 with the firearm lock 202 partially installed. FIG. 6 shows the firearm 200 with the firearm lock 202 in the locked, safe position. Firearm lock 202 comprises a casing 204, a locking member 206, and a flexible member 208 between the casing 210 and the locking member 206. The flexible member 208 has a tip 212 for engaging with the engagement port 214 of the locking member 206.

To lock the firearm 200 in the safe position, the slide 222 is retracted to expose the chamber 224. The chamber 224, in a preferred embodiment, is empty when the slide 222 is initially retracted. If the firearm still has ammunition in the magazine 226 or the chamber 224, the ammunition should be removed prior to locking the firearm. With the chamber 224 empty, the flexible member 208, which is fixedly attached to the casing 204, may be inserted into at least one the chamber 204 with the tip 212 first. In some embodiments, the flexible member 208 may be inserted into the ejection port or the opening of the magazine. The flexible member 208 may then be pushed longitudinally along the barrel 228 until the tip 212 of the flexible member protrudes from the muzzle end 230 of the firearm 200, and is visibly exposed at the muzzle end 230 of the firearm, as shown in FIGS. 4-5. When the tip 212 of the flexible member 208 is visibly exposed at the muzzle end 230 of the firearm, the casing 204 is positioned in the chamber 224 of the firearm, as shown in FIGS. 4-5. The engagement port 214 on the locking member 206 may then be engaged with the tip 212 at the muzzle end 230 of the firearm. The user may then operate the security feature 216 of the locking member 206 until the firearm lock 202 is in the locked position, and thus the firearm 200 is in a safe position. While in the safe position, the firearm lock extends between the chamber 224 and the muzzle end 230 of the firearm, preventing a round from being loaded into the chamber 224 and fired through the barrel 228 of the gun.

Because the casing 204 is selected based upon the caliber of ammunition for the firearm 200, the diameter of the casing 204 of the firearm lock prevents the firearm lock 202 from being pulled from the muzzle end 230 along the barrel 228 when the firearm lock 202 is in the locked position. The diameter of the casing 204 is too large to move further down the barrel 238 and out the muzzle end 230 of the firearm 200.

While in the safe position, the sights 232 on the weapon are unobstructed by the firearm lock 202. While in the safe position, the slide 222 is free to move forwards and backwards. While in the safe position, a user may operate the trigger 234 safely to "dry fire" the firearm 200. While in the safe position, the firearm lock 202 does not obstruct the user from handling the grip 236 as the user normally would. While in the safe position, the user can practice inserting and removing magazines 226 from the firearm 200. Thus, with the firearm lock 202 in the safe position within the firearm 200, the user can practice various self-defense and tactical scenarios with the firearm to help build the user's skill set, the user's familiarity with the firearm, and the user's confidence with the firearm.

To remove the firearm lock 202, a user first operates the security feature 216 of the locking member 206 until the locking member 206 is disabled. The locking member 206 may then be disengaged with the tip 212 of the flexible member 208 of the lock 202. The slide 222 can be positioned to expose the chamber 224, and the casing 204 and the flexible member 208 can then be withdrawn from the firearm through the chamber 224 and pulled out at least one of the ejection port or the opening for the magazine, or any other entry point for the chamber. In some embodiments, the casing may comprise a retrieval feature, such as a grip or notch, to assist a user with extracting the hollow casing and the flexible member from the barrel of the firearm.

Although the description and figures herein show the firearm lock for use with a particular handgun or pistol, it is contemplated by the invention described herein that the firearm lock may be modified for suitable use in any handgun, shotgun, rifle, or other types of firearms. In at least one embodiment for use in a shotgun, rifle, or other long-barreled firearm, the lock may be modified to use a longer flexible member between the casing and the tip. In embodiments for use in a shotgun, rifle, or other long-barreled firearm, the flexible member may be stiffer or more rigid than the flexible member used in other embodiments for the firearm lock for the handgun or pistol. It is worth noting, however, that the firearm lock described herein is not suitable for use with revolvers or as a dry fire device for revolvers.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

The invention claimed is:

1. A safety lock for a firearm, the safety lock comprising:

a casing at a first end, the casing having a chamber end and a barrel end, the casing having a first diameter at the chamber end and a second diameter near the barrel end, wherein the second diameter is larger than the first diameter, wherein the casing is hollow;

a releasable locking member at a second end; and a flexible member between the first end and the second end, the flexible member connected to the casing at the barrel end of the casing, wherein when the safety lock is installed in a safe position within a chamber and a barrel of the firearm to lock the firearm, the second diameter of the casing obstructs the barrel while permitting safe operation of a trigger of the firearm.

2. The safety lock of claim 1, wherein the casing is sized for the firearm.

3. The safety lock of claim 1, wherein the casing comprises a retrieval feature to remove the lock from the chamber.

4. The safety lock of claim 1, wherein the flexible member comprises a metal.

5. The safety lock of claim 1, wherein the flexible member has a coating.

6. The safety lock of claim 1, wherein the releasable locking member has a security feature that enables the locking member to be released from the flexible member.

7. The safety lock of claim 1, wherein the releasable locking member comprises a padlock body.

8. The safety lock of claim 1, wherein the flexible member has a tip at the second end for engagement with the releasable locking member.

9. The safety lock of claim 1, wherein the casing is a dry fire device.

10. A locked firearm comprising:

a chamber;

a muzzle end;

a barrel extending from the chamber to the muzzle end; and a lock extending along the barrel from the chamber to the muzzle end, the lock comprising:

a shell casing at a first end positioned in the chamber, the shell casing having a chamber end and a barrel end, the shell casing having a first diameter at the chamber end and a second diameter near the barrel end, wherein the second diameter is larger than the first diameter;

a flexible member connected to the barrel end of the shell casing, the flexible member extending along the barrel; and a locking member at a second end, the locking member removably engaged with the flexible member, wherein the lock allows a user to insert a magazine clip of the locked firearm, remove the magazine clip of the locked firearm, operate a trigger of the locked firearm, and operate the slide of the locked firearm.

11. The locked firearm of claim 10, further comprising sights, wherein the sights are unobstructed by the lock.

12. A method of locking a firearm, the method comprising:

retracting a slide of the firearm to expose a chamber of the firearm;

inserting an end of a flexible member into the chamber;

feeding the flexible member through a barrel of the firearm until a tip of the flexible member is exposed from a muzzle of the firearm and a casing attached to the flexible member is positioned into the chamber, wherein the casing is hollow; and engaging a locking member with the tip of the flexible member, wherein the casing has a chamber end and a barrel end attached to the flexible member, the casing having a first diameter at the chamber end and a second diameter near the barrel end, wherein the second diameter is larger than the first diameter and the second diameter of the casing obstructs the barrel while permitting safe operation of a trigger of the firearm.

13. The locked firearm of claim 10, wherein the casing is hollow.

* * * * *